US006292964B1

(12) United States Patent
Rose et al.

(10) Patent No.: US 6,292,964 B1
(45) Date of Patent: Sep. 25, 2001

(54) INCLINED SUPPORT PILLOW

(76) Inventors: Macarena M. Rose; Erin L. Koogle, both of 6881 40th Ave. North, St. Petersburg, FL (US) 33709

( * ) Notice: Subject to any disclaimer, the term of this patent is extended or adjusted under 35 U.S.C. 154(b) by 0 days.

(21) Appl. No.: 09/775,755

(22) Filed: Feb. 5, 2001

(51) Int. Cl.[7] ..... A47C 20/02
(52) U.S. Cl. ..... 5/630; 5/632; 5/655; 5/657
(58) Field of Search ..... 5/630, 632, 633, 5/638, 655, 657

(56) References Cited

U.S. PATENT DOCUMENTS

| | | | | |
|---|---|---|---|---|
| 3,009,172 | * | 11/1961 | Eidam | 5/632 |
| 3,648,308 | * | 3/1972 | Greenawalt | 5/633 |
| 4,471,767 | * | 9/1984 | Guimond | 5/655 |
| 4,862,535 | * | 9/1989 | Roberts | 5/655 |
| 5,014,376 | * | 5/1991 | Doran | 5/655 |
| 5,237,713 | * | 8/1993 | Prager | 5/632 |
| 5,439,008 | * | 8/1995 | Bowman | 5/655 |
| 5,448,790 | * | 9/1995 | Saro et al. | 5/657 |
| 5,697,112 | | 12/1997 | Colavito . | |

* cited by examiner

*Primary Examiner*—Michael F. Trettel
*Assistant Examiner*—Michael Trettel
(74) *Attorney, Agent, or Firm*—Thomas Frost

(57) ABSTRACT

An inclined support pillow includes a foam wedge and a resilient foam section substantially of the same length and width as a top surface of the foam wedge, with the bottom surface of the foam section attached to the top surface of the foam wedge. A covering of fabric or cloth is dimensioned for securement over the foam wedge and the foam section. At least two fastening strips are attached to the covering on a plane parallel to a top surface of the foam section. Two resilient cushions, each having a semi-circled top surface, a flat bottom surface and a covering of fabric or cloth, are provided with complementary fastening strips attached to the covering on a plane parallel to the flat bottom surface. The two cushions are aligned with the top surface of the foam section by press mating the complementary fastening strips to the fastening strips. The first of the cushions is relatively larger than the second cushion. The first cushion is to be used for lower back support and the second cushion for neck support. The fastening strips and complementary fastening strips may be made of Velcro-type material.

7 Claims, 3 Drawing Sheets

FIG. 1
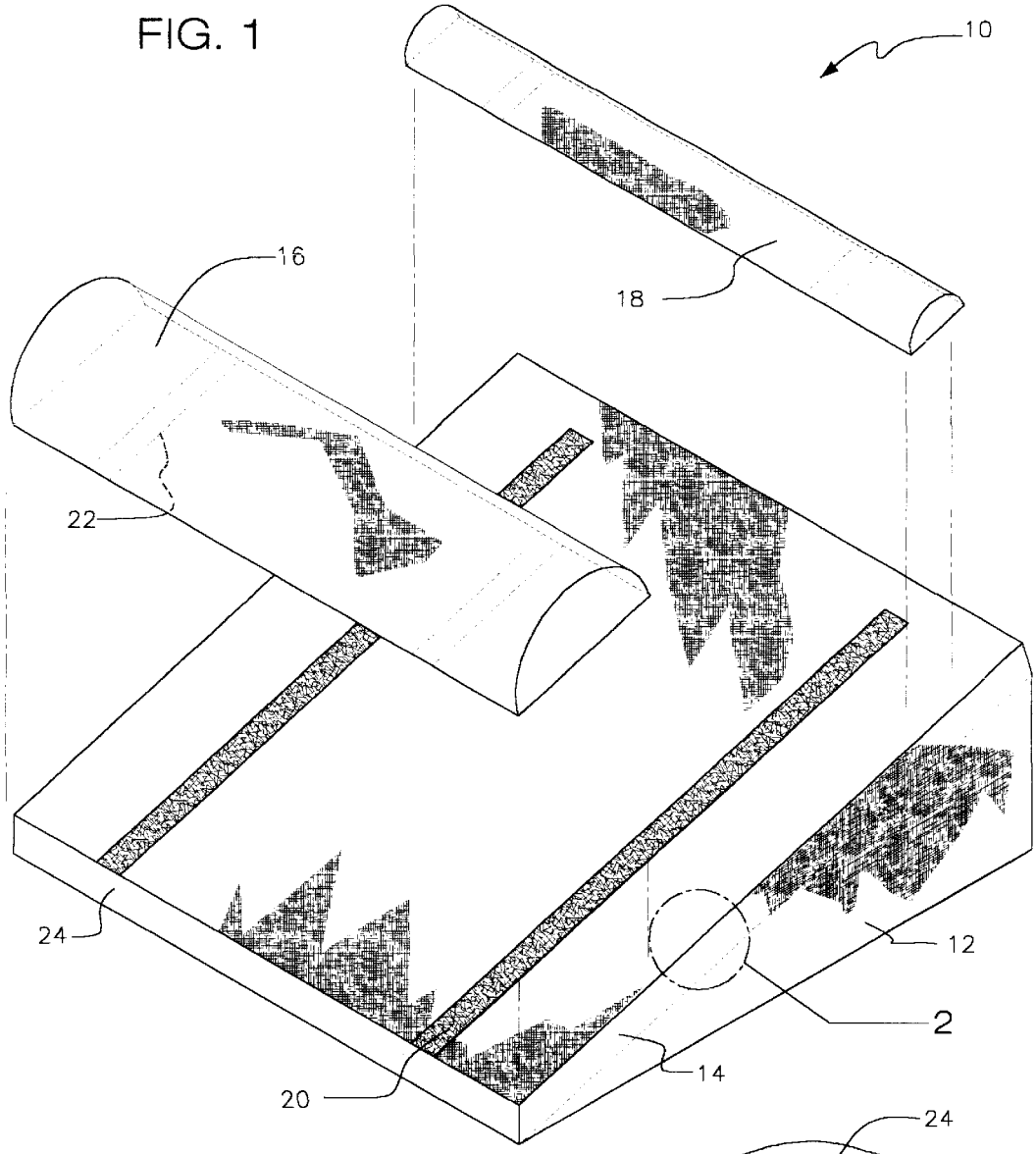
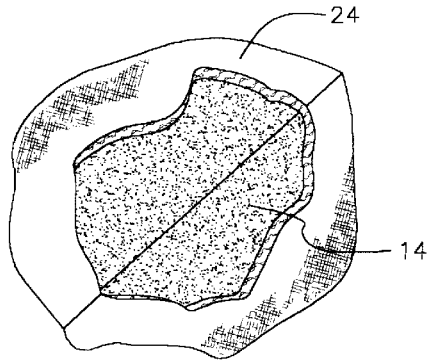
FIG. 2

INCLINED SUPPORT PILLOW

CROSS-REFERENCE TO RELATED APPLICATIONS

Not applicable.

FEDERAL SPONSORED RESEARCH OF DEVELOPMENT

Not applicable.

BACKGROUND OF THE INVENTION

1. Field of the Invention

The present invention relates to an inclined support pillow with a foam wedge, a resilient foam section attached to the foam wedge, a covering over the foam wedge and the foam section, along with two resilient cushions positioned to be attached to the covering. The invention provides comfort and cervical/lumbar area support for individuals having gastroesophageal reflux disease (GERD), esophageal hernia problems and other similar conditions. More particularly, the invention allows users to rearrange the cushions to desired location for comfort, and neck and lower back support.

2. Description of the Related Art

The use of foam wedge pillows and multiple pillows to help individuals having GERD and other health conditions is known in the prior art. The elevation of the upper torso helps relieve the discomfort of GERD by decreasing esophageal acid exposure while the users of the pillows are on their backs. Elevation of the upper torso also helps individuals with esophageal hernias and other conditions where esophageal acid exposure causes discomfort or physical damage.

By providing elevation the users of the foam wedge pillows and multiple pillows are able to more efficiently sleep, read and watch television.

Most of the prior foam wedge pillows for such elevative use lack adequate cervical area and/or lumbar area back support. Separate supports are not provided for the lower back and neck. Additionally, foam wedge pillows, to give adequate support, are formed from rather rigid material. The rigid nature of the wedge pillow increases the discomfort of the user.

U.S. Pat. No. 5,697,112 to Colavito, et al., discloses a foam wedge pillow useful for treating GERD and other applications. This pillow consists of a foam wedge pillow with a plastic container in a recess in the top surface of the wedge pillow. Weight distribution, and the lessening of neck and back stiffness, is obtained by filling the container with a fluid, such as water. Although the foam wedge pillow of this patent provides the desired function of lessening some of the back and neck discomfort associated with wedge shaped pillows, it is rather bulky to operate and maintain. The invention of this patent lacks the separate and movable resilient cushions for back support provided by the present invention. An additional layer of support is also provided by the present invention.

Therefore, the need exists for an improved inclined support pillow of sound ergonomic design, which is of a relatively simple construction, yet provides for individual, and rearrangeable, lower back and neck support. Additional comfort is also provided by having a resilient foam section attached to the top surface of the relatively less resilient foam wedge.

SUMMARY OF THE INVENTION

In view of the foregoing disadvantages inherent in known types of foam wedge pillows or multiple pillows, the present invention provides an improved support pillow for individuals having gastroesophageal reflux disease (GERD) and other physical ailments, allowing users to read, watch television and sleep in greater comfort. The general purpose of the invention, which will be described in greater detail, is to provide separate cushions for the neck and lower back areas of users, which cushions can be located as needed by the user. An additional layer of support is also provided by having a relatively more resilient foam section on the top surface of a foam wedge.

The present invention comprises a foam wedge having a top and bottom surface, with a relatively elevated upper first end and a relatively lowered second end. A resilient foam section, having a top surface, bottom surface, and a first and second end, and substantially the same length and width of the top surface of the foam wedge, is attached to the top surface of the foam wedge. The first end of the foam section is aligned with the upper end of the foam wedge and the second end of the foam section is aligned with the lower second end of the foam wedge.

The foam wedge and foam section combination is inserted into a covering made of fabric or cloth. At least least two fastening strips, having a first and second end, are attached to the covering, and are positioned on the surface of the covering that is parallel to the top surface of the foam section. The first end of each of the fastening strips is attached approximately four inches from the edge aligned with the first end of the resilient foam section and run longitudinally to approximately the edge aligned with the second end of the foam section.

A first resilient and second resilient foam cushion, each with a generally semi-circled shaped top surface and flat bottom surface, are provided to be attached to the top surface of the covering parallel with the foam section for lower back and neck support. The cushions are substantially the same width as the top surface of the foam section. The first cushion, used for lower back support, is relatively larger than the second cushion which is used for neck support. The cushions are individually inserted into a covering of fabric or cloth dimensioned for securement over the cushions. At least two complementary fastening strips are attached to the covering of each cushion, and are positioned on the surface of the covering that is parallel to the flat bottom surface of the cushions. The complementary fastening strips are attached to the covering of the cushions in a location so as to allow engagement with the fastening strips. The cushions can then be engaged to the surface of the covering running parallel to the top surface of the foam section by press mating the complementary fastening strips to the fastening strips.

The cushions can be adjusted to fit the needs of individuals taking into consideration the height and the location of the individual's neck for support with the second cushion.

It is an object of the present invention to provide a new and improved inclined pillow for sleeping, reading, watching television and/or any other situation where comfort and angled support are needed for persons having gastroesophageal reflux disease (GERD) and other similar ailments.

It is another object of the present invention to provide an additional layer of support to the foam wedge pillows now on the market.

It is another object of the present invention to provide separate cushions for lower back and neck support on the inclined surfaces which cushions can be located and readjusted on the inclined surface of the pillow to compensate for the individual's upper torso size.

The above and other objects, features and advantages of the present invention will become apparent from the following detailed description taken with the accompanying drawings.

BRIEF DESCRIPTION OF THE DRAWINGS

FIG. 1 is a perspective view of the inclined support pillow with the cushions removed therefrom to show the relative location of the cushions and the fastening strips.

FIG. 2 is an elevated side view of section 2 of FIG. 1 of the inclined support pillow with the covering removed revealing the visco-elastic foam material of the foam section.

DETAILED DESCRIPTION OF THE INVENTION

Figure 3:
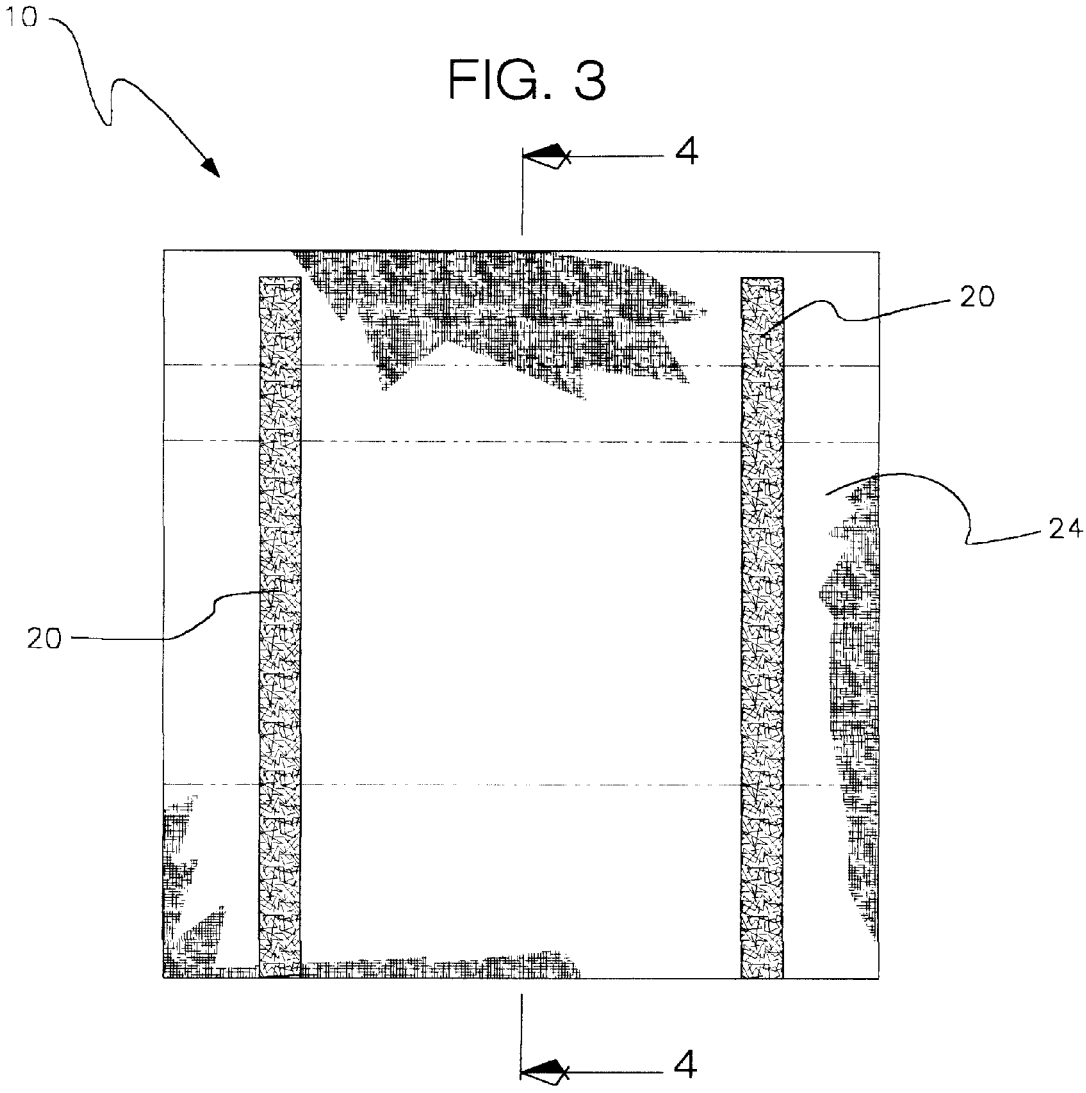
FIG. 3 is a top plan view of the inclined support pillow with the cushions removed and showing the position of the fastening strips attached to the covering.

The present invention is an inclined support pillow designed to provide comfort to individuals having gastroesophageal reflux disease (GERD) and other health-related conditions where there exists a need to decrease esophageal acid exposure. By elevating the upper torso the effect that the acidity exhibits on an individual is lessened. The pillow is an improvement over foam wedges in the prior art because it provides an additional layer of support attached to the foam wedge, and also provides separate resilient cushions for the lower back and neck areas. The individual's upper torso is elevated, allowing the support for the lower back and neck areas to be located according to the length of the individual's upper torso.

The pillow is not limited to the dimensions set forth in the described embodiment, and may be useful for any individual seeking increased comfort in sleeping, reading or watching television while their upper torso is elevated.

With reference to the drawings, the preferred embodiment of the new and improved inclined support pillow embodying the principles and concepts of the present invention and generally designated by the reference number 10 will be described.

Referring to FIG. 1, the inclined support pillow 10 consists of a foam wedge 12, a resilient foam section 14, a first cushion 16, a second cushion 18, fastening strips 20, complementary fastening strips 22 and a covering 24. The foam wedge 12 has a top and bottom surface, with a relatively elevated upper first end and a relatively lower second end. The foam wedge 12 is formed of a single block of foam material. Polyurethane foam is preferably provided as material for the foam wedge 12, although applicant believes that other materials may be utilized. The foam wedge 12 is approximately 30 inches wide, 30 inches long and 9 inches high at the first end.

The foam section 14 has a top surface, bottom surface, first end and second end. The foam section 14 is substantially the same length and width as the top surface of the foam wedge 12, is approximately 2 inches in depth, and the bottom surface of the foam section 14 is secured to the top surface of the foam wedge 14 by glue or comparable substance. The first end of the foam section 14 is aligned with the relatively elevated first end of the foam wedge 12 and the second end of the foam section 14 is aligned with relatively lower second end of the foam wedge 12. The foam section 14 is formed of a single block of foam material. Visco-elastic foam is preferred, although applicant believes that other resilient materials may be utilized.

The attachment of the foam section 14 to the top surface of the foam wedge 12 provides an additional layer of support not present in conventional foam wedges.

The covering 24 is dimensioned for securement over the combination of the foam section 14 and the foam wedge 12. FIG. 2 shows a portion of the covering 24 removed to show the resilient foam material of the foam section 14. The covering 24 may be made of any suitable fabric or cloth. The covering 24 is used to protect the foam wedge 12 and the foam section 14, along with providing an area of attachment for the fastening strips 20.

FIGS. 1 and 3 show at least 2 fastening strips 20 of a predetermined length and width, having a top surface and a bottom surface, attached to the covering 24 on a plane parallel to the top surface of the foam section 14. The bottom surface of the fastening strips 20 are attached to the covering 24 with glue or a comparable substance. The fastening strips 20 are aligned perpendicular to the first end of the foam section 14, and are attached to the covering 24 from a position starting at approximately 4 inches from the edge of the covering 24 in alignment with the first end of the foam section 14 and continuing to approximately the edge of the covering 24 in alignment with the second end of the foam section 14. The fastening strips 20 are preferably comprised of hook and loop fastener material, sold under the trademark VELCRO although other suitable attachment materials, such as materials comprised of snaps or hooks, may be used.

Referring to FIG. 1, the first cushion 16 and the second cushion 18 are comprised of a generally semi-circled shaped top surface, a flat bottom surface, first end and second end, and are covered with suitable fabric or cloth. The first cushion 16 and the second cushion 18 are substantially the same width as the width of the foam section 14. The first cushion 16 and second cushion 18 are each formed from a single block of foam material. As with the foam section 14, Visco-elastic foam is preferred although applicant believes that other resilient materials may be utilized.

At least two complementary fastening strips 22 of a predetermined length and width, having a top surface and a bottom surface, are attached to the covering material of the first cushion 16 and the second cushion 18 on a plane parallel to the flat bottom surface. The bottom surface of each one of the complementary fastening strips 22 is attached to the covering material with glue or comparable substance. The complementary fastening strips 22 are preferably comprised of Velcro-typed material, although other suitable attachment materials may be used if such materials allow the mating of the complementary fastening strips 22 to the fastening material strips 20. The complementary fastening strips 22 are positioned in a perpendicular manner to the first end and the second end of the first cushion 16, and the second cushion 18, so as to be in a position to allow engagement with the fastening strips 20.

Figure 4:
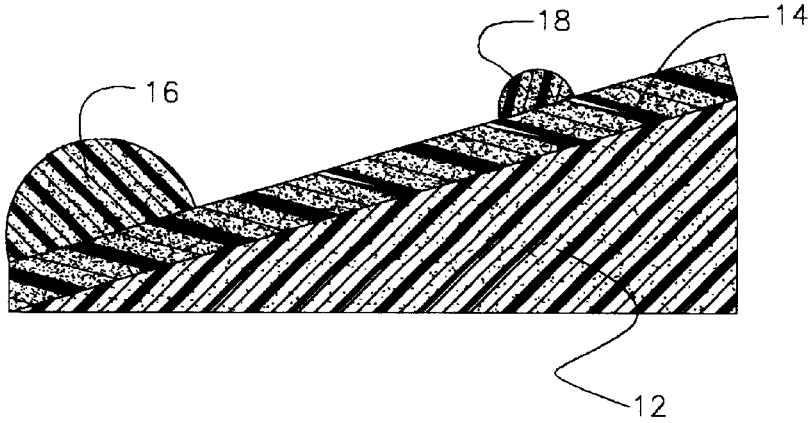
FIG. 4 is a vertical cross-sectional view of the inclined support pillow of the present invention.

The first cushion 16 and the second cushion 18 are connected with the fastening strips 20 by press mating the complementary fastening strips 22 on the fastening strips 20. As FIGS. 1 and 4 show, the first cushion 16 is to be used for lower back support and is to be substantially aligned with the second end of the foam section 14. The second cushion 18 is to be used for neck support and is intended to be aligned relatively nearer to the first end of the foam section 14.

The top surface of the first cushion 16 has a relatively larger radius of curvature compared to the top surface of the second cushion 18, due to the greater area of support needed for the lower back area. The top surface of the first cushion 16 has a radius of curvature between 3 inches and 5 inches, while the top surface of the second cushion 18 has a radius of curvature between 1.5 inches and 2.5 inches.

Users of the pillow 10 position themselves on their back with their upper torso elevated. The first cushion 16 and the second cushion 18 can be adjusted to the height and particular comfort needs of the individual by attaching to a different level on the fastening strips 20. As can be seen in FIG. 4 the pillow 10 provides an area for users to locate and support the back of their heads while on their backs.

Figure 5:
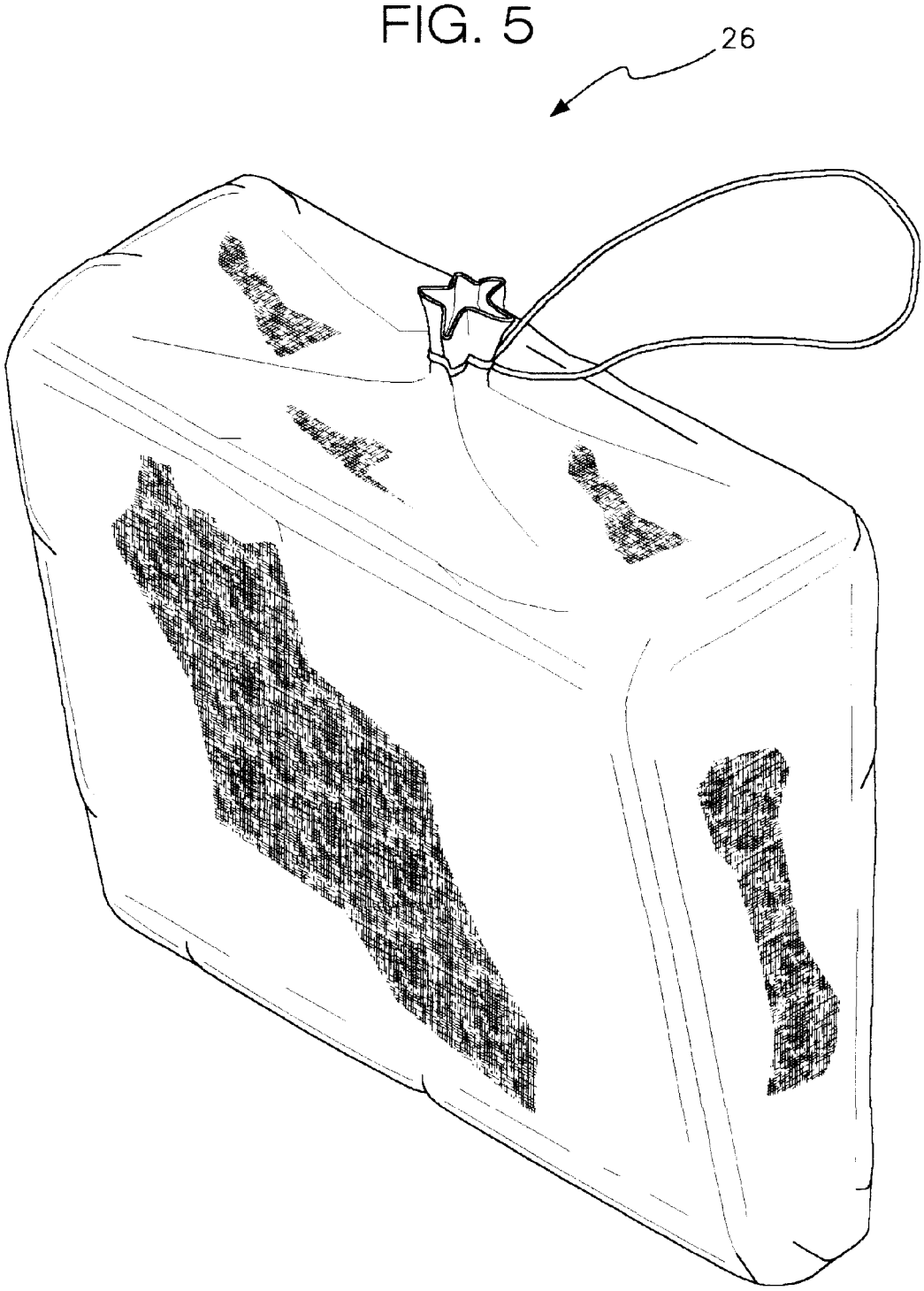
FIG. 5 is a perspective view of an optional covering into which the inclined support pillow may be inserted during use or for storage.

Referring to FIG. 5, an optional covering 26 may be provided as a cover for the pillow 10 during use.

The pillow 10 is an improvement over prior foam wedges or multiple pillows because it provides increased individualized lower back and neck support, while at the same time allowing individuals suffering from gastroesophageal reflux disease (GERD) and similar ailments to relieve the effects of esophageal acid exposure.

With respect to the above described embodiment, it is contemplated that the pillow 10 may be constructed in various sizes and dimensions, and all equivalent relationships to those illustrated in the drawings and described in the specification are intended to emcompassed by the present invention. It will be apparent to those skilled in this art that various modifications may be made without departing from the spirit of the present invention.

We claim:

1. An inclined support pillow comprising:

a foam wedge having a top surface, a bottom surface, and a relatively elevated upper first end and a relatively lowered second end, the foam wedge being about 30 inches wide, 30 inches long and 9 inches high at the first end;

a resilient foam section having a top surface and a bottom surface, a first end and a second end, the foam section being substantially the same length and width as the top surface of the foam wedge, the first end of the foam section being in substantial alignment with the upper first end of the top surface of the foam wedge and the second end of the foam section being in substantial alignment with the lowered second end of the top surface of the foam wedge, the foam section being about 2 inches in depth and the bottom surface of the foam section being attached to the top surface of the foam wedge by glue;

a covering of fabric or cloth dimensioned for securement over the foam section and the foam wedge combination after the foam section is attached to the foam wedge;

at least two fastening strips made of hook and loop fastener material, each having a first end, a second end, a top surface and a bottom surface, of predetermined length and width, the bottom surface of each of the fastening strips attached by glue to the covering on a plane parallel to the top surface of the foam section, the first end and the second end of the fastening strips being aligned perpendicular to the first end of the foam section and the second end of the foam section, the first end of each of the fastening strips being attached to the covering at a position starting at approximately 4 inches from the edge of the covering in alignment with the first end of the foam section and the second end of each of the fastening strips being attached to a position at the edge of the covering in alignment with the second end of the foam section;

a resilient first cushion having a generally semi-circular shaped top surface, a flat bottom surface, a first end and a second end, and a covering of fabric or cloth dimensioned for securement over the first cushion, a resilient second cushion having a generally semi-circular shaped top surface, a flat bottom surface, a first end and a second end, and a covering of fabric or cloth dimensioned for securement over the second cushion, the first cushion and the second cushion being substantially the same width as the width of the foam section, the top surface of the first cushion having a relatively larger radius of curvature than the top surface of the second cushion; and at least two complementary fastening strips made of hook and loop fastener material, of a predetermined length and width, each having a first end, a second end, a top surface and a bottom surface, the bottom surface of the complementary fastening strips attached by glue to the coverings of the first cushion and the second cushion on a plane parallel to the bottom surface of the cushions, the first end of the complementary fastening strips being attached to the covering at a position in relative alignment with the first end of the cushions and the second end of the complementary fastening strips being attached to the covering at a position in relative alignment with the second end of the cushions, the complementary fastening strips being attached to the covering of the cushions so as to be in a position to engage with the fastening strips, the first cushion serving to provide lower back support by press mating the top surface of the complementary fastening strips attached to the first cushion on the top surface of the fastening strips in an area relatively nearer the second end of the foam section, and the second cushion serving to provide neck support by press mating the top surface of the complementary fastening strips attached to the second cushion on the top surface of the fastening strips in an area relatively nearer to the first end of the foam section.

2. The inclined support pillow defined in claim 1 in which the foam wedge is formed from polyurethane.

3. The inclined support pillow defined in claim 1 in which the foam section is formed from visco-elastic foam.

4. The inclined support pillow defined in claim 1 in which the first cushion and the second cushion are formed from visco-elastic foam.

5. The inclined support pillow defined in claim 1 in which the top surface of the first cushion has a radius of curvature between 3 inches and 5 inches.

6. The inclined support pillow defined in claim 1 in which the top surface of the second cushion has a radius of curvature between 1.5 inches and 2.5 inches.

7. The inclined support pillow defined in claim 1 further comprising an optional covering into which the inclined support pillow is inserted.

* * * * *